US008690113B1

(12) United States Patent
Wright et al.

(10) Patent No.: US 8,690,113 B1
(45) Date of Patent: Apr. 8, 2014

(54) APPARATUS AND METHOD FOR INSTALLATION OF AN AFFIXATION POINT

(71) Applicants: Jurgen Wright, Choctaw, OK (US); Shannon Wright, Choctaw, OK (US); Scott King, Oklahoma City, OK (US); Corey King, Oklahoma City, OK (US)

(72) Inventors: Jurgen Wright, Choctaw, OK (US); Shannon Wright, Choctaw, OK (US); Scott King, Oklahoma City, OK (US); Corey King, Oklahoma City, OK (US)

( * ) Notice: Subject to any disclaimer, the term of this patent is extended or adjusted under 35 U.S.C. 154(b) by 0 days.

(21) Appl. No.: 13/750,168

(22) Filed: Jan. 25, 2013

(51) Int. Cl.
*A47G 1/24* (2006.01)

(52) U.S. Cl.
USPC ..... 248/477; 248/480; 248/489; 248/497; 248/498; 52/705

(58) Field of Classification Search
USPC ..... 52/705; 248/475.1, 476, 477, 480, 489, 248/495, 497, 498
See application file for complete search history.

(56) References Cited

U.S. PATENT DOCUMENTS

| | | | | | |
|---|---|---|---|---|---|
| 2,681,194 | A * | 6/1954 | Halvorsen | 248/495 |
| 2,697,572 | A * | 12/1954 | Pfankuch | 248/495 |
| 2,920,853 | A * | 1/1960 | Bufogle | 248/214 |
| 3,128,979 | A * | 4/1964 | Damileo | 248/680 |
| 3,664,626 | A * | 5/1972 | Sneller | 248/224.7 |
| 4,364,537 | A * | 12/1982 | Helzer | 248/448 |
| 4,804,161 | A * | 2/1989 | Wallo | 248/544 |
| 5,069,411 | A * | 12/1991 | Murphy | 248/476 |
| 5,743,507 | A * | 4/1998 | Rushing | 248/495 |
| 6,003,825 | A * | 12/1999 | Abernathy, Jr. | 248/478 |
| 6,299,123 | B1 * | 10/2001 | Hayde | 248/476 |
| 7,677,521 | B2 * | 3/2010 | Price | 248/475.1 |
| 2006/0054771 | A1 * | 3/2006 | Lie | 248/489 |

* cited by examiner

*Primary Examiner* — William Gilbert
*Assistant Examiner* — Alp Akbasli
(74) *Attorney, Agent, or Firm* — Edward L. White

(57) ABSTRACT

An adjustable affixation point apparatus comprising an anchor means for providing secure engagement with a wall; a fastener adapted to releasably engage the anchor means and to retain an extension arm between the head and the wall; the extension arm having a channel adapted to slidingly receive the fastener; at least one engagement means for enhancing the frictional contact among the members; a hanger attached to the distal end providing an affixation point which can be mounted into a wall near a desired location, then a sliding and rotational action of the extension arm relative to the allows a user to adjust the hangar to any point within a 360 degree radius and extending outwardly to any point along the length of the arm and to fix the hanger in a desired location.

13 Claims, 1 Drawing Sheet

APPARATUS AND METHOD FOR INSTALLATION OF AN AFFIXATION POINT

CROSS-REFERENCE TO RELATED APPLICATIONS

None.

FIELD OF THE INVENTION

The invention relates to apparatus for affixing items to a wall. More particularly, the invention relates to apparatus providing flexibility and ease of installation regarding the precise affixation point to engage an item at a desired location on a wall.

SUMMARY OF THE INVENTION

The invention relates to devices for mounting objects on a wall. More particularly, the invention relates to devices that allow flexibility in the location of an affixation point for an object to be affixed to a wall. The invention allows 360 degree adjustment of an affixation point around an anchor and a defined distance out therefrom—corresponding to the length of an arm. Locating a picture or other object in exactly the desired location on a wall can be difficult. Traditional means of affixing an object to a wall are not adjustable; rather they are fixed in place relative to their point of penetration or other affixation to a wall. In general, prior art teaches various devices from a simple nail or screw to complicated devices for affixing an object to a wall.

In view of the obvious limitation of affixation points that cannot be adjusted except by again puncturing or otherwise damaging the wall, there are a plethora of prior art devices that are intended to allow for adjustable affixation of an object to a wall.

U.S. Pat. No. 6,003,825 to Abernathy, Jr. teaches an adjustable wall hanging device. Abernathy teaches a device with cross members that allow for vertical adjustment of an affixation points and also allows for provision of at least a pair of substantially vertically parallel affixation points that can be adjusted vertically and horizontally, but it is a complicated apparatus, and the device taught by Abernathy cannot be extended meaningfully to the left or right of a point at which the device is anchored to the wall.

U.S. Pat. No. 6,152,418 to Panicci teaches several related devices to adjustably affix an object to a wall. As with Abernathy, however, Panicci does not allow for affixation of the anchor any significant distance outside of the two points at which it is anchored to a wall.

U.S. Pat. No. 7,578,492 to Dane teaches an adjustable hanger that has an elongated, slotted bracket member having a wall mounting position at one end. It allows adjustment of an affixation point at a variety of heights. Dane teaches no means to stabilize the slotted bracket member, which would be required to allow it to provide for adjustment in the horizontal direction.

The present invention overcomes these shortcomings in the prior art by providing a simple yet secure affixation point, which can easily be adjusted in a 360 degree field around an anchor point out a reasonable distance from that point.

There have thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in this application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. Additional benefits and advantages of the present invention will become apparent in those skilled in the art to which the present invention relates from the subsequent description of the preferred embodiment and the appended claims, taken in conjunction with the accompanying drawings. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

DETAILED DESCRIPTION OF THE INVENTION

Figure 1:
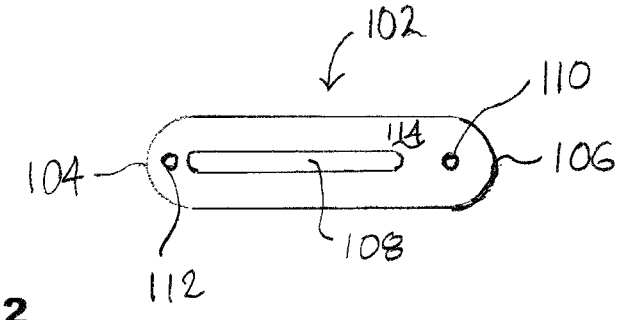
FIG. 1 is a top view of the arm.

FIG. 1 is a top view of the arm 102. The arm 102 has a first end 104 and a second end 106. Defined in the arm 102 is a channel 108 adapted to receive a hanger 120 (see FIG. 4). A hanger hole 110 is defined near the second end 106.

Figure 2:
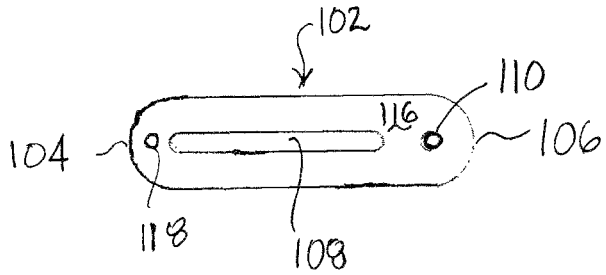
FIG. 2 is a bottom view of the arm.
Figure 3:
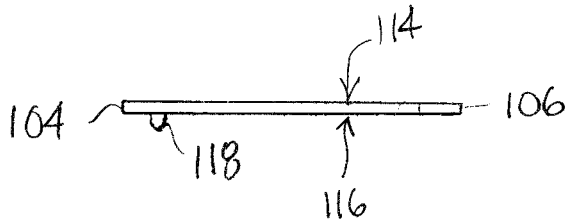
FIG. 3 is a side view of the arm.

An indention 112 associated with a dimple 118 (see FIG. 2) is defined near the first end 104, which is one embodiment in which a dimple 118 is defined to project out from a bottom surface 116 (see FIG. 3). In this embodiment, the dimple 118 is created by extruding a region of the arm 102 leaving the indention 112 defined on the top surface 114 and a corresponding dimple 118 projecting out from the bottom surface 116.

FIG. 2 is a bottom view of the arm 102. As noted, the dimple 118 is seen projecting out from the bottom surface 116.

Figure 4:
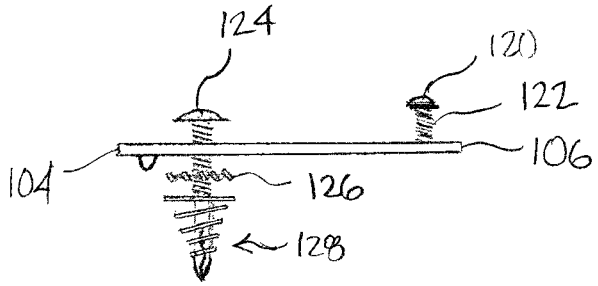
FIG. 4 is a side view of an embodiment of the apparatus.

FIGS. 1 and 2 both show the hanger hole 110, which defines therein threads to cooperate with corresponding hanger threads 122 (see FIG. 4).

FIG. 3 is a side view of the arm 102. FIG. 3 shows the dimple 118, and both the top and bottom surfaces 114 and 116, respectively.

FIG. 4 shows an embodiment of the apparatus, illustrating the cooperative relationships of its component parts. The hanger 120 and its threads 122 threadedly engage the hanger hole 110 near the second end 106. The fastener 124 passes through the channel 108 and also passes through a lock washer 126 and then into an anchor 128.

A self-drilling hollow wall anchor is disclosed by U.S. Pat. No. 7,320,569 to Kaye et al. Kaye teaches a high-strength failure-resistant hollow wall anchor having a self-drilling threaded installation structure adapted to be broken, after positioning in a wall, by an inserted screw, into expandable anchoring elements. The anchor taught by Kaye is incorporated herein by reference.

A lock washer with unequally projecting teeth is disclosed by U.S. Pat. No. 2,770,277 to Jules. Jules taught a lock washer with external teeth, that is, with teeth along its outer circumference. However, lock washers with teeth along both a washer's outer circumference as well as along an inner circumference through which a bolt or screw passes are now commercially available. A simple Internet search for "internal external tooth lock washer" will reveal multiple commercially available washers of this type. Washers as described with internal and/or external teeth are incorporated herein by reference.

The purpose of the abstract is to enable the U.S. Patent and Trademark Office and the public generally, and especially the scientist, engineers and practitioners in the art who are not familiar with patent or legal terms or phraseology, to determine quickly from an inspection the nature and essence of the technical disclosure of the application. The abstract is neither intended to define the invention of the application which is measured by the claims, nor is it intended to be limiting as to the scope of the invention in any way.

Unless defined otherwise, all technical and scientific terms used herein have the same meanings as commonly understood by one of ordinary skill in the art to which this invention belongs. While various methods of use and structures of the present invention are described herein, any methods or structures similar or equivalent to those described herein may be used in the practice or testing of the present invention. All references cited herein are incorporated by reference in their entirety and for all purposes. In addition, while the foregoing advantages of the present invention are manifested in the illustrated embodiments of the invention, a variety of changes can be made to the configuration, design and construction of the invention to achieve those advantages including combinations of components of the various embodiments. Hence, reference herein to specific details of the structure and function of the present invention is by way of example only and not by way of limitation.

While the invention has been shown, illustrated, described and disclosed in terms of specific embodiments or modifications, the scope of the invention is not limited by the precise embodiments or modifications therein shown, illustrated, described or disclosed. Such other embodiments or modifications are intended to be reserved especially as they fall within the scope of the claims herein appended.

We claim:

1. An adjustable affixation point apparatus providing a 360 degrees field of adjustment within a length of an extension arm, the apparatus comprising:

f. an anchor comprising a self-drilling threaded anchor adapted to be divided, after positioning, by an inserted fastener into expandable anti-rotation elements;

g. a fastener adapted to releasably engage the anchor means, the fastener having a shaft terminating at one thereof in a head adapted to be disposed exteriorly relative to the wall and further adapted to retain the extension arm between the head and the wall;

h. the extension arm having a length, a proximal end and a distal end and defining there between a channel defined between two shoulders adapted to slidingly receive the fastener such that the shaft is slidingly received within the channel, but the head cannot pass therethrough and, instead, in a mounted position, frictionally engages the shoulders;

i. at least one engagement means for enhancing the frictional contact among at least one of the anchor, the arm, the fastener, and the wall;

j. a hanger attached to the distal end and projecting outwardly from the wall, the hanger providing an affixation point;

whereby, an anchor can be mounted into a wall near a desired location, then a sliding and rotational action of the extension arm relative to the anchor means allows a user to adjust the hangar to any point within a 360 degree radius and extending outwardly to any point along the length of the arm and to fix the hanger in a desired location upon full engagement of the fastener with the anchor means, the apparatus being held more firmly in place by the engagement means.

2. The apparatus of claim 1 where the engagement means comprises at least one lock washer having at least one set of teeth selected from internal and external configurations, each washer disposed in a location between members selected from the anchor, the arm, and the fastener.

3. The apparatus of claim 1 where the engagement means comprises at least one dimple projecting outwardly from an opposite surface from which the hanger projects, each dimple adapted to engage the wall to prevent movement of the arm relative to the wall.

4. The apparatus of claim 1 having as an additional element a fastener installed after the anchor has been set and a desired location for the hanger has been determined, within the channel at a point distant from the anchor means thereby providing additional stability.

5. The apparatus of claim 1 where the distal end of the arm is adapted to interchangeably engage more than one type of hanger.

6. The apparatus of claim 1 where the affixation point, in an installed position, is prevented from movement by an adhesive applied during its installation.

7. The apparatus of claim 1 where the anchor means comprises a structural support member of a wall into which the fastener engages.

8. An adjustable affixation point apparatus comprising:

a. a self-drilling threaded anchor adapted to be divided, after positioning, by an inserted fastener, into expandable anti-rotation elements;

b. a fastener adapted to releasably engage the anchor means, the fastener having a shaft and a head at an end thereof adapted to be disposed exteriorly relative to the wall and further adapted to retain an extension arm between the head and the wall;

c. the extension arm having a length, a proximal end and a distal end and defining there between a channel defined between two shoulders adapted to slidingly receive the fastener such that the shaft is slidingly received within the channel, but the head cannot pass therethrough and, instead, in a mounted position, frictionally engages the shoulders;

d. at least one at least one lock washer having at least one set of teeth selected from internal and external configurations, each washer disposed in a location between members selected from the anchor, the arm, and the fastener adapted, upon mounting of the apparatus, to enhance the frictional contact among at least one of the anchor, the arm, and the fastener;

e. a hanger attached to the distal end and projecting outwardly from the wall, the hanger providing an affixation point; and f. an engagement means comprising at least one dimple projecting outwardly from an opposite surface from which the hanger projects, each dimple adapted to engage the wall to prevent movement of the arm relative to the wall, whereby, an anchor can be mounted into a wall near a desired location, then a sliding and rotational action of the extension arm relative to the fastener engaged in the anchor, allows a user to adjust the hangar to any point within a 360 degree radius and extending outwardly to any point along the length of the arm and to fix the hanger in a desired location upon full engagement of the fastener with the anchor means, which is held firmly in place by the each lock washer.

9. The apparatus of claim 8 having as an additional element a self-drilling screw, whereby, once the apparatus has been installed so that the hanger is affixed at a desired location, the screw is installed within the channel at a point distant from the anchor thereby providing additional stability.

10. The apparatus of claim 8 where the distal end of the arm is adapted to interchangeably engage more than one type of cooperating hanger.

11. The apparatus of claim 8 where the affixation point, in an installed position, is prevented from movement by an adhesive applied during its installation.

12. The apparatus of claim 8 where the anchor means comprises a fastener directly engaging a solid support member.

13. An adjustable affixation point apparatus providing a 360 degrees field of adjustment within a length of an extension arm, the apparatus comprising:

a. an anchor means for providing a secure anchor point engaged with a wall;

b. a fastener adapted to releasably engage the anchor means, the fastener having a shaft terminating at one thereof in a head adapted to be disposed exteriorly relative to the wall and further adapted to retain the extension arm between the head and the wall;

c. the extension arm having a length, a proximal end and a distal end and defining there between a channel defined between two shoulders adapted to slidingly receive the fastener such that the shaft is slidingly received within the channel, but the head cannot pass therethrough and, instead, in a mounted position, frictionally engages the shoulders;

d. a hanger attached to the distal end and projecting outwardly from the wall, the hanger providing an affixation point; and e. at least one dimple projecting outwardly from an opposite surface from which the hanger projects, each dimple adapted to engage the wall to prevent movement of the arm relative to the wall;

whereby, an anchor can be mounted into a wall near a desired location, then a sliding and rotational action of the extension arm relative to the anchor means allows a user to adjust the hangar to any point within a 360 degree radius and extending outwardly to any point along the length of the arm and to fix the hanger in a desired location upon full engagement of the fastener with the anchor means, the apparatus being held more firmly in place by the engagement means.

* * * * *